US011036247B1

(12) United States Patent
Wei

(10) Patent No.: US 11,036,247 B1
(45) Date of Patent: Jun. 15, 2021

(54) VOLTAGE REGULATOR CIRCUIT WITH HIGH POWER SUPPLY REJECTION RATIO

(71) Applicant: Shenzhen Goodix Technology Co., Ltd., Shenzhen (CN)

(72) Inventor: Dazhi Wei, Austin, TX (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/699,080

(22) Filed: Nov. 28, 2019

(51) Int. Cl.
*G05F 1/575* (2006.01)

(52) U.S. Cl.
CPC ..... *G05F 1/575* (2013.01)

(58) Field of Classification Search
CPC ..... G05F 1/10; G05F 1/40; G05F 1/56; G05F 1/561; G05F 1/562; G05F 1/565; G05F 1/573; G05F 1/575; G05F 1/44; G05F 1/445; G05F 1/46; G05F 1/461; G05F 1/462; G05F 1/466; G05F 1/467; G05F 1/468; G05F 1/59; G05F 1/625; G05F 1/63; G05F 1/644; G05F 1/648; G05F 1/652; G05F 3/26; G05F 3/222; H02M 3/00; H02M 3/04; H02M 3/155; H02M 3/156–3/158; H02M 3/1582; H02M 3/1584; H02M 3/1588; H02M 2001/0009; H02M 2001/0003; H02M 2003/1566
See application file for complete search history.

(56) References Cited

U.S. PATENT DOCUMENTS 6,856,124 B2 * 2/2005 Dearn ..... G05F 1/575 323/273
7,405,546 B2 * 7/2008 Amrani ..... G05F 1/565 323/273

(Continued)

FOREIGN PATENT DOCUMENTS

CN 102681581 A 9/2012
CN 202838077 U 3/2013

(Continued)

OTHER PUBLICATIONS

International search report dated Feb. 19, 2021 recieved in the corresponding PCT Application PCT/CN2020/129908.

*Primary Examiner* — Thienvu V Tran
*Assistant Examiner* — Nusrat Quddus
(74) *Attorney, Agent, or Firm* — Kilpatrick Townsend & Stockton LLP

(57) ABSTRACT

A voltage regulator circuit includes a power supply terminal and a ground terminal, and a differential amplifier coupled between the power supply terminal and the ground terminal. The voltage regulator circuit also includes an output transistor, which includes a gate node coupled to an output node of the differential amplifier to receive a gate voltage and to provide a regulated output voltage at an output node of the output transistor. The differential amplifier is configured to provide the gate voltage based on a differential between a reference voltage and the regulated output voltage. The voltage regulator also includes a compensation capacitance coupled between a virtual ground node in the differential (Continued)

amplifier and either the power supply terminal or the ground terminal and a virtual ground node in the differential amplifier.

19 Claims, 8 Drawing Sheets

(56) References Cited

U.S. PATENT DOCUMENTS 7,535,208 B2 * 5/2009 De Cremoux ..... G05F 1/46 323/277
7,982,448 B1 * 7/2011 Prasad ..... G05F 1/56 323/315
8,305,056 B2 * 11/2012 Wadhwa ..... G05F 1/56 323/270
8,513,929 B2 * 8/2013 Drebinger ..... G05F 1/575 323/273
8,604,762 B2 * 12/2013 Bakkaloglu ..... H03F 1/26 323/280
8,917,069 B2 * 12/2014 Howes ..... G05F 1/575 323/266
9,024,602 B2 * 5/2015 Fort ..... G05F 1/46 323/280
9,195,249 B2 * 11/2015 Chen ..... G05F 1/575
9,389,620 B2 * 7/2016 Banag ..... G05F 1/46
9,553,548 B2 * 1/2017 Park ..... G05F 1/625
9,651,965 B2 * 5/2017 Cui ..... G05F 1/575
9,671,805 B2 * 6/2017 Drebinger ..... H03F 3/45183
9,740,225 B1 * 8/2017 Wong ..... G05F 1/575
9,778,672 B1 * 10/2017 Gao ..... G05F 1/575
9,887,674 B2 * 2/2018 Ramos ..... H03F 1/14
9,983,604 B2 * 5/2018 Lee ..... G09G 3/3696
10,338,614 B1 * 7/2019 Day ..... G05F 1/44
10,545,521 B2 * 1/2020 Ramos ..... G05F 1/575
10,591,938 B1 * 3/2020 Golara ..... H03F 3/45183
2008/0048627 A1 * 2/2008 Kobayashi ..... G05F 1/56 323/271
2009/0273323 A1 * 11/2009 Kimura ..... G05F 1/575 323/265
2010/0253431 A1 * 10/2010 Fujiwara ..... G05F 1/575 330/253
2013/0257401 A1 * 10/2013 Fort ..... G05F 1/46 323/280
2013/0257542 A1 10/2013 Kao
2015/0130292 A1 5/2015 Yeon et al.
2016/0062377 A1 * 3/2016 Fort ..... G05F 1/575 323/280
2016/0308497 A1 * 10/2016 Park ..... G05F 1/625
2017/0090493 A1 * 3/2017 Cui ..... G05F 1/575
2017/0090495 A1 * 3/2017 Ramos ..... G05F 1/575
2018/0097488 A1 * 4/2018 Giuffredi ..... H03F 1/26
2019/0123648 A1 4/2019 Huang et al.

FOREIGN PATENT DOCUMENTS

CN 103713682 A 4/2014
CN 104536506 A 4/2015
CN 106444947 A 2/2017
CN 107402591 A 11/2017
CN 110011536 A 7/2019
CN 110221643 A 9/2019

* cited by examiner

VOLTAGE REGULATOR CIRCUIT WITH HIGH POWER SUPPLY REJECTION RATIO

CROSS-REFERENCES TO RELATED APPLICATIONS

This application is related to U.S. patent application Ser. No. 16/699,076, entitled "DISTRIBUTED LOW-DROP-OUT VOLTAGE REGULATOR (LDO) WITH UNIFORM POWER DELIVERY," filed concurrently, the content of which is incorporated by reference herein.

BACKGROUND OF THE INVENTION

Voltage regulators, in particular linear voltage regulators, are devices that are used to maintain a steady voltage. A low-dropout or LDO regulator is a DC linear voltage regulator that can regulate the output voltage even when the supply voltage is very close to the output voltage. Such voltage regulators have broad applicability. For example, voltage regulators may be utilized with analog-to-digital converters (ADC), application specific integrated circuits (ASICs), field programmable gate arrays (FPGAs) and other high performance/high power products. The voltage regulators may provide clean (e.g., steady) output voltage to one or more components of these high performance/high power products even in instances where input voltage into the voltage regulator is close to the output voltage.

A parameter for measuring the performance of linear regulators is PSRR (Power Supply Rejection Ratio, Power Supply Ripple Rejection, or Power supply ripple rejection ratio). PSRR describes the capability of the linear regulator to avoid undesired supply noise/interference from coupling to LDO output. High PSRR over a wide frequency range is difficult to achieve for LDO with reasonable power consumption. In a linear regulator having a high PSRR, power supply noise and interferences will not be coupled to the sensitive output, to provide quiet power supply to the circuit.

BRIEF SUMMARY OF THE INVENTION

As described above, high PSRR is desirable in linear regulators, including LDO voltage regulators. Conventional approaches to maintain PSRR often involve wide bandwidth and high gain. However, these approaches need large devices and high power consumption. In embodiments of the present invention, using a compensation capacitance inserted in a proper location as described herein, substantial improvement in PSRR can be achieved without large device size and high power consumption.

According to some embodiments of the present invention, a linear voltage regulator circuit includes a power supply terminal and a ground terminal, and a differential amplifier coupled between the power supply terminal and the ground terminal. The differential amplifier is configured to amplify a differential between a reference voltage and a regulated output voltage. The differential amplifier includes a pair of input transistors, a pair of bias transistors, and a pair of current mirror transistors coupled between the power supply terminal and the ground terminal. The differential amplifier also includes a bias voltage coupled to a gate node of each of the pair of bias transistors, and a virtual ground node at a source node of one of the pair of bias transistors. The linear voltage regulator also includes an output transistor, which includes a gate node coupled to the differential amplifier, a source node coupled to the power supply terminal, and a drain node providing the regulated output voltage. The linear voltage regulator further includes a compensation capacitor coupled between the power supply terminal and the virtual ground node in the differential amplifier to provide a current between the power supply terminal and the gate node of the output transistor to reduce effects of capacitances coupled to the gate node that degrade PSRR of the voltage regulator.

In some embodiments of the above voltage regulator, the pair of input transistors includes a first transistor for receiving a sample of the regulated output voltage and a second transistor for receiving a reference voltage. The pair of bias transistors includes a third transistor and a fourth transistor coupled between the pair of input transistors and the pair of current mirror transistors. A bias voltage is coupled to respective gate nodes of the third and fourth transistors. The pair of current mirror transistors includes a fifth transistor and a sixth transistor having their respective gate nodes coupled together and coupled to a drain node of the fifth transistor. The virtual ground node is at a source node of the third or the fourth transistor.

In some embodiments, the first, second, third, and fourth transistors are N-channel transistors, and the fifth and sixth transistors are P-channel transistors In some embodiments, the output transistor is an P-channel transistor, and the regulated output voltage is provided at a drain node of the output transistor.

In some embodiments, the output transistor is an N-channel transistor, and the regulated output voltage is provided a source node of the output transistor.

According to some embodiments of the present invention, a voltage regulator circuit includes a power supply terminal and a ground terminal, and a differential amplifier coupled between the power supply terminal and the ground terminal. The voltage regulator circuit also includes an output transistor, which includes a gate node coupled to an output node of the differential amplifier to receive a gate voltage and to provide a regulated output voltage at an output node of the output transistor. The differential amplifier is configured to provide the gate voltage based on a differential between a reference voltage and the regulated output voltage. The voltage regulator also includes a compensation capacitance coupled between a virtual ground node and either the power supply terminal or the ground terminal and a virtual ground node in the differential amplifier.

In some embodiments of the above voltage regulator, the compensation capacitance is configured to reduce effects of capacitances that degrade PSRR (Power Supply Rejection Ratio).

In some embodiments the differential amplifier includes a pair of input transistors, a pair of bias transistors, and a pair of current mirror transistors coupled between the power supply terminal and the ground terminal. A bias voltage is coupled to a gate node of each of the pair of bias transistors, and the virtual ground node is at a source node of one of the pair of bias transistors.

In some embodiments, the pair of input transistors includes a first transistor for receiving a sample of the regulated output voltage and a second transistor for receiving a reference voltage. The pair of bias transistors includes a third transistor and a fourth transistor coupled between the pair of input transistors and the pair of current mirror transistors. A bias voltage is coupled to respective gate nodes of the third and fourth transistors. The pair of current mirror transistors includes a fifth transistor and a sixth transistor having their respective gate nodes coupled together and coupled to a drain node of the fifth transistor. The virtual ground node is located at a source node of the third or the fourth transistor.

In some embodiments, the compensation capacitance is coupled between a power supply terminal and the virtual ground node. In some embodiments, the first, second, third, and fourth transistors are N-channel transistors; and the fifth and sixth transistors are P-channel transistors.

In some embodiments, the output transistor is an P-channel transistor, and the output node is a drain node of the output transistor.

In some embodiments, the output transistor is an N-channel transistor, and the output node is a source node of the output transistor.

In some embodiments, the output transistor is an N-channel transistor, and the output node is a drain node of the N-channel transistor.

In some embodiments, the compensation capacitance is coupled between a ground terminal and the virtual ground node. In some embodiments, the first, second, third, and fourth transistors are P-channel transistors, and the fifth and sixth transistors are N-channel transistors.

According to some embodiments of the present invention, a method includes providing a voltage regulator having a differential amplifier coupled to a gate node of an output transistor, and providing a virtual ground node in the voltage regulator. The method also includes determining an optimal capacitance value for a compensation capacitor between a power terminal and the virtual ground node for improving PSRR (Power Supply Rejection Ratio) of the voltage regulator. The method further includes coupling a compensation capacitor having the optimal capacitance value between the power terminal and the virtual ground node in the differential amplifier.

In some embodiments, the method further includes performing voltage regulation using the voltage regulator with the compensation capacitor.

In some embodiments, the differential amplifier includes a pair of input transistors, a pair of bias transistors, and a pair of current mirror transistors coupled between a power supply terminal and a ground terminal. A bias voltage is coupled to a gate node of each of the pair of bias transistors, and the virtual ground node is located at a source node of one of the pair of bias transistors.

In some embodiments, determining a capacitance value includes using circuit simulation technique to determine an optimal capacitance value.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a second label that distinguishes among the similar components. If only the first reference label is used in the specification, the description can be applicable to any one of the similar components having the same first reference label irrespective of the second reference label.

DETAILED DESCRIPTION OF THE INVENTION

In the following description, for the purposes of explanation, specific details are set forth in order to provide a thorough understanding of certain inventive embodiments. However, it will be apparent that various embodiments may be practiced without these specific details. The figures and description are not intended to be restrictive. The word "exemplary" is used herein to mean "serving as an example, instance, or illustration". Any embodiment or design described herein as "exemplary" is not necessarily to be construed as preferred or advantageous over other embodiments or designs.

Although this disclosure may reference MOSFET based LDOs it is within the scope of this disclosure to apply the techniques herein to voltage regulators of different configurations, including, Bipolar Junction Transistor (BJT) LDOs, BJT switch transistors, and the like.

Figure 1:
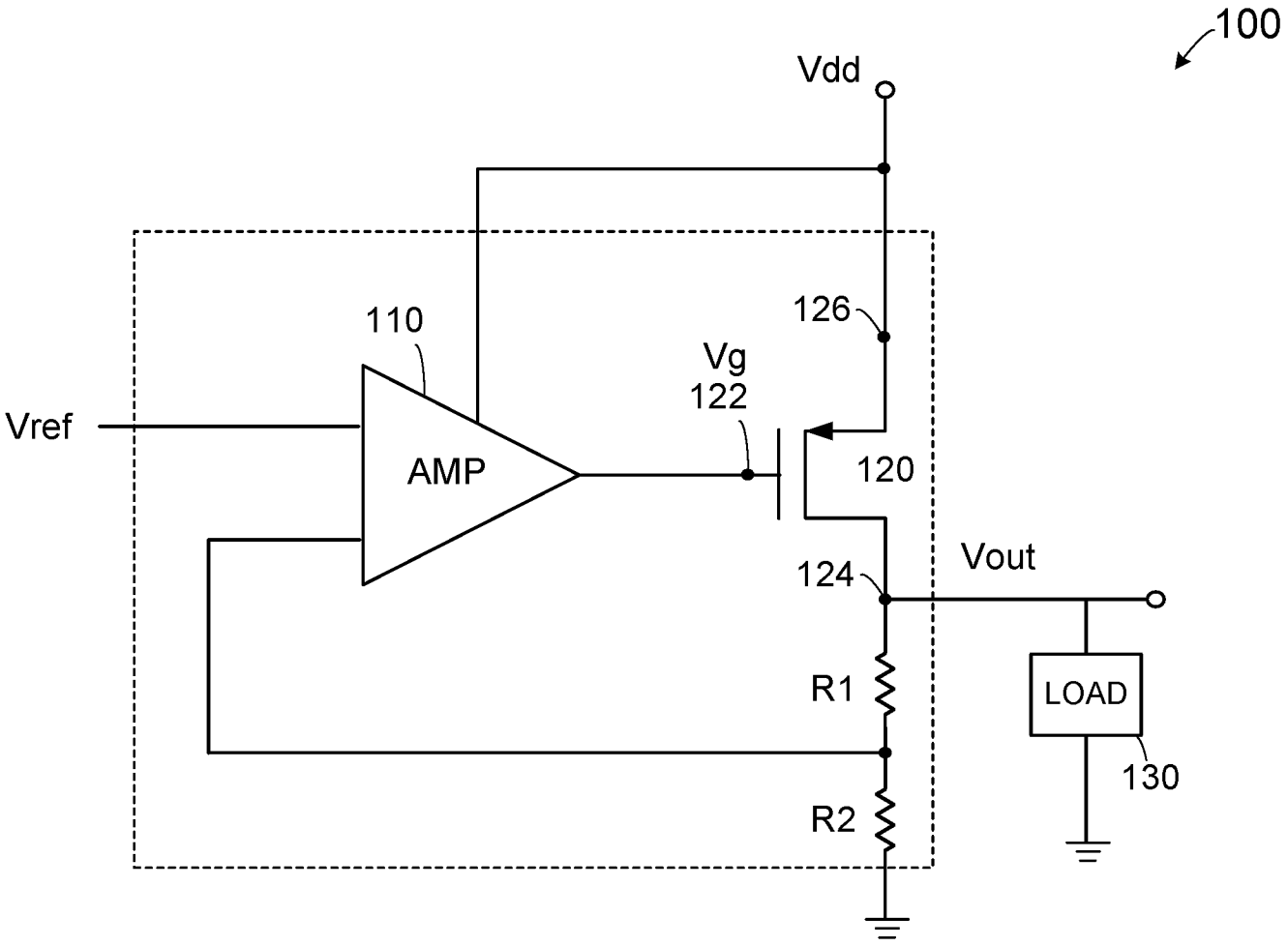
FIG. 1 is a simplified schematic diagram illustrating an example of a low-dropout voltage regulator (LDO) according to some embodiments of the present invention.

FIG. 1 is a simplified schematic diagram illustrating an example of a low-dropout voltage regulator (LDO) according to some embodiments of the present invention. A low-dropout or LDO regulator is a DC linear voltage regulator which can regulate the output voltage. The main components of the LDO regulator can include a differential amplifier and an output transistor. FIG. 1 illustrates an example of LDO 100, in which the differential amplifier 110 can be an error amplifier, and the output transistor 120 can be a power FET (field effect transistor). Differential amplifier 110 is configured to amplify a differential between a reference voltage Vref and a regulated output voltage Vout sampled by a voltage divider formed by resistors R1 and R2. An output of the differential amplifier 110 is coupled to a gate node 122 of output transistor 120. The regulated output voltage Vout is derived at an output node 124 of output transistor 120. The gate voltage at gate node 122 is designated as Vg in FIG. 1. FIG. 1 also shows a power supply Vdd that provides operational power to LDO 100. A load device 130 receives power provided by LDO 100.

The low-dropout voltage regulator (LDO) illustrated in FIG. 1 is an example of a linear regulator is an electronic circuit used to maintain a steady voltage. As illustrated in FIG. 1, one input of the differential amplifier 110 monitors the output Vout, and the second input to the differential amplifier 110 receives the control signal, which in this case is reference voltage Vref. If the output voltage rises too high relative to the reference voltage, the drive to the power FET changes to maintain a constant output voltage.

LDO 100 in FIG. 1 has an open drain topology. Output transistor 120 is P-channel MOS (Metal Oxide Semiconductor) transistor, also designated as a PMOS transistor, with a source node 126 coupled to power supply Vdd, and a drain node 124 serving as an output node, to which load device is attached. In this topology, the output transistor 120 may be easily driven into saturation with the voltages available to the regulator. This allows the voltage drop from the unregulated voltage Vdd to the regulated voltage Vout to be as low as the saturation voltage across the transistor.

Figure 2:
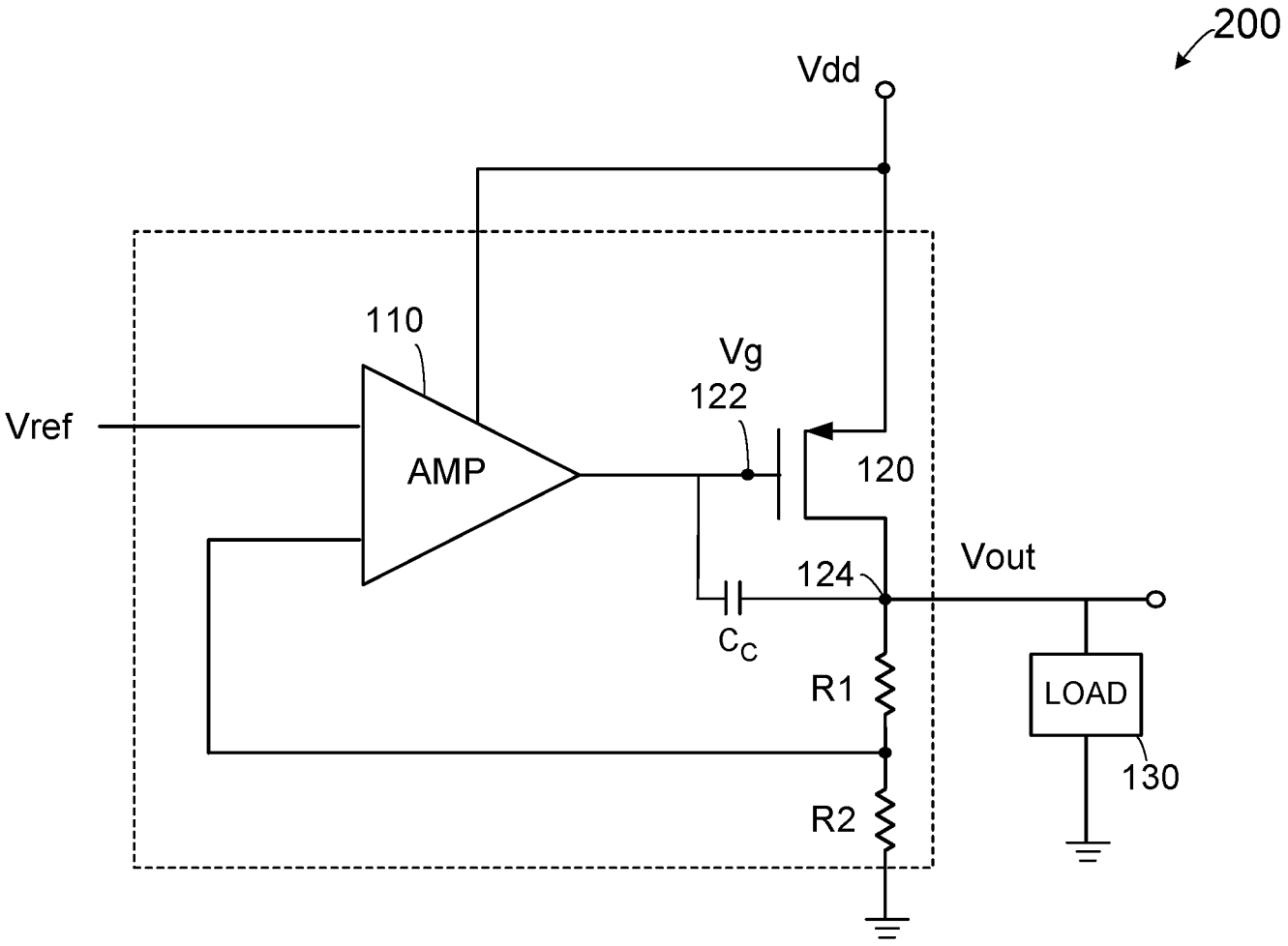
FIG. 2 is a simplified schematic diagram illustrating an LDO having a gate-to-source capacitance according to some embodiments of the present invention.

FIG. 2 is a simplified schematic diagram illustrating an LDO having a gate-to-source capacitance according to some embodiments of the present invention. As shown in FIG. 2, LDO 200 is similar to LDO 100 of FIG. 1. Therefore, similar components are labeled with the same reference numerals. One difference is that FIG. 2 shows a capacitance Cc coupled between the gate node and the drain node. Capacitance Cc can represent the built-in gate-drain overlap capacitance of transistor 120 or a Miller capacitor that is added to the circuit to improve stability.

These capacitances can increase the input capacitance of output transistor 120 and degrade the PSRR of the circuit. In the mid to high frequency range, especially at frequencies higher than the unity gain bandwidth of the feedback loop, the PSRR degradation can be due to the undesired capacitive coupling from the power transistor gate Vg to other low impedance nodes. For example, when Vdd rises or drops, the gate voltage Vg cannot follow exactly Vdd due to current drawn from capacitance Cc. Therefore, an AC current (which is equal to transconductance gm multiplied by gate-source voltage Vgs) is injected to Vout and degrades the PSRR performance. In this example, Cc is just an example of undesired capacitive coupling. Other undesired capacitive coupling includes those coupled to a bias voltage or the ground, etc., which can also degrade PSRR.

Figure 3:
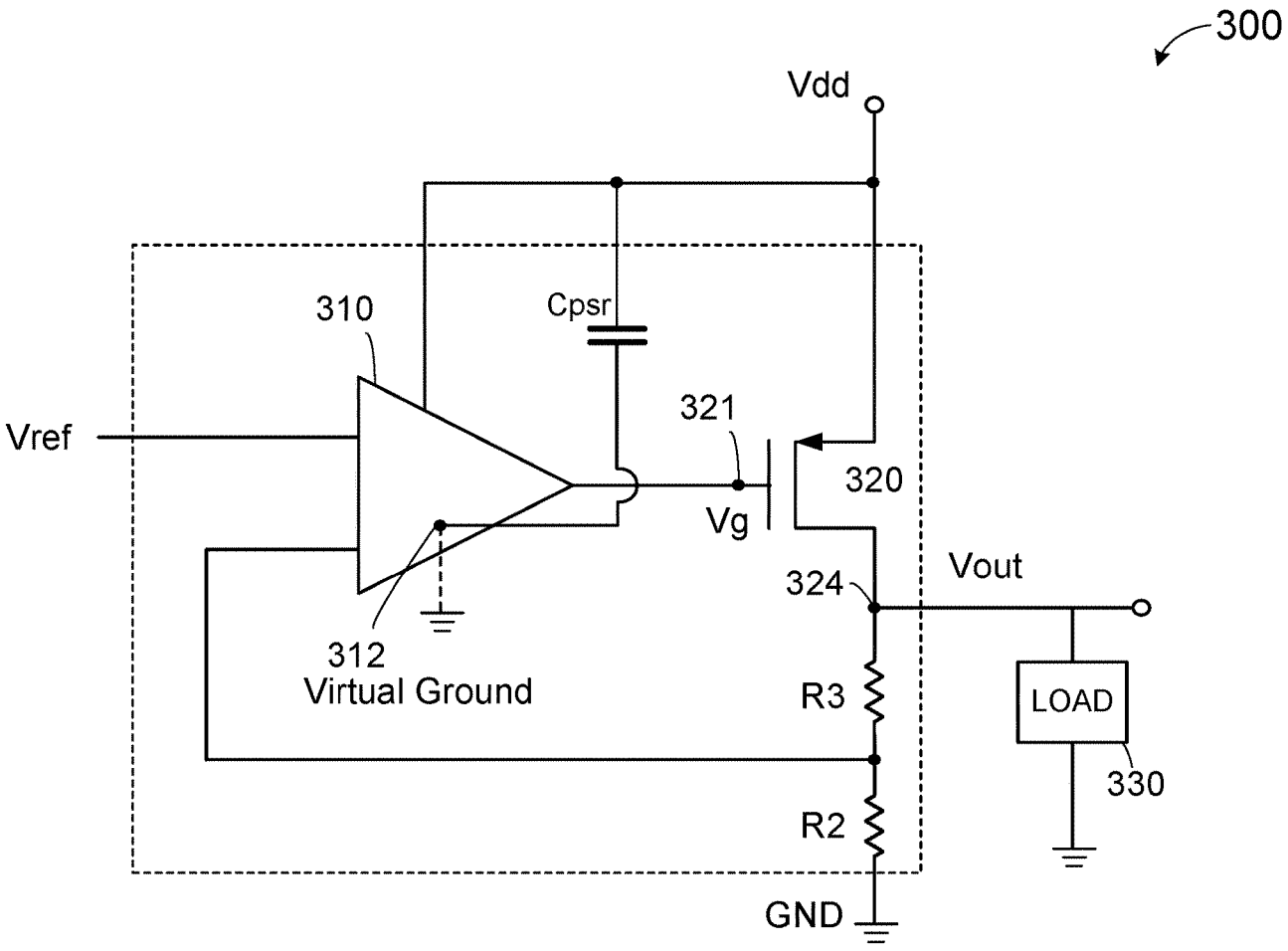
FIG. 3 is a simplified schematic diagram illustrating a linear regulator having an improved PSRR according to some embodiments of the present invention.

FIG. 3 is a simplified schematic diagram illustrating a linear regulator having an improved PSRR according to some embodiments of the present invention. As shown in FIG. 3, LDO 300 is similar to LDO 100 of FIG. 1. LDO 300 is a low dropout (LDO) linear voltage regulator circuit that includes a power supply terminal and a ground terminal. LDO 300 also includes a differential amplifier 310 coupled between the power supply terminal and the ground terminal. An output transistor 320 includes a gate node 321 coupled to an output node of the differential amplifier 310 to receive a gate voltage Vg and to provide a regulated output voltage Vout at an output node 324 of the output transistor. Differential amplifier 310 is configured to provide the gate voltage Vg based on a differential between a reference voltage Vref and the regulated output voltage Vout. FIG. 3 also shows a load device 330.

One difference between LDO 300 in FIG. 3 and LDO 100 in FIG. 1 is that LDO 300 in FIG. 3 includes a compensation capacitance Cpsr coupled between the power supply voltage Vdd and a virtual ground node 312 in the differential amplifier 310 to provide a current to the gate node of the output transistor to improve PSRR (power supply rejection ratio). Compensation capacitance Cpsr is configured to provide a current to the gate node of the output transistor to improve the PSRR (power supply rejection ratio) of the circuit.

The virtual ground node 312 is a circuit node with a very low impedance that allows a current to the gate node 321 to vary, while maintaining a substantially constant voltage. As an example, a virtual ground node can be located at a source node of an MOS transistor having a constant gate bias voltage. The drain node of the MOS transistor is coupled to a constant current source and the gate node 321 of the output transistor 320. In some embodiments, the constant current source can be provided by a current mirror in the differential amplifier, as described in more detail in connection to FIGS. 4-7. Alternatively, the constant current source can be provided by a separate current source outside of the differential amplifier.

Figure 4:
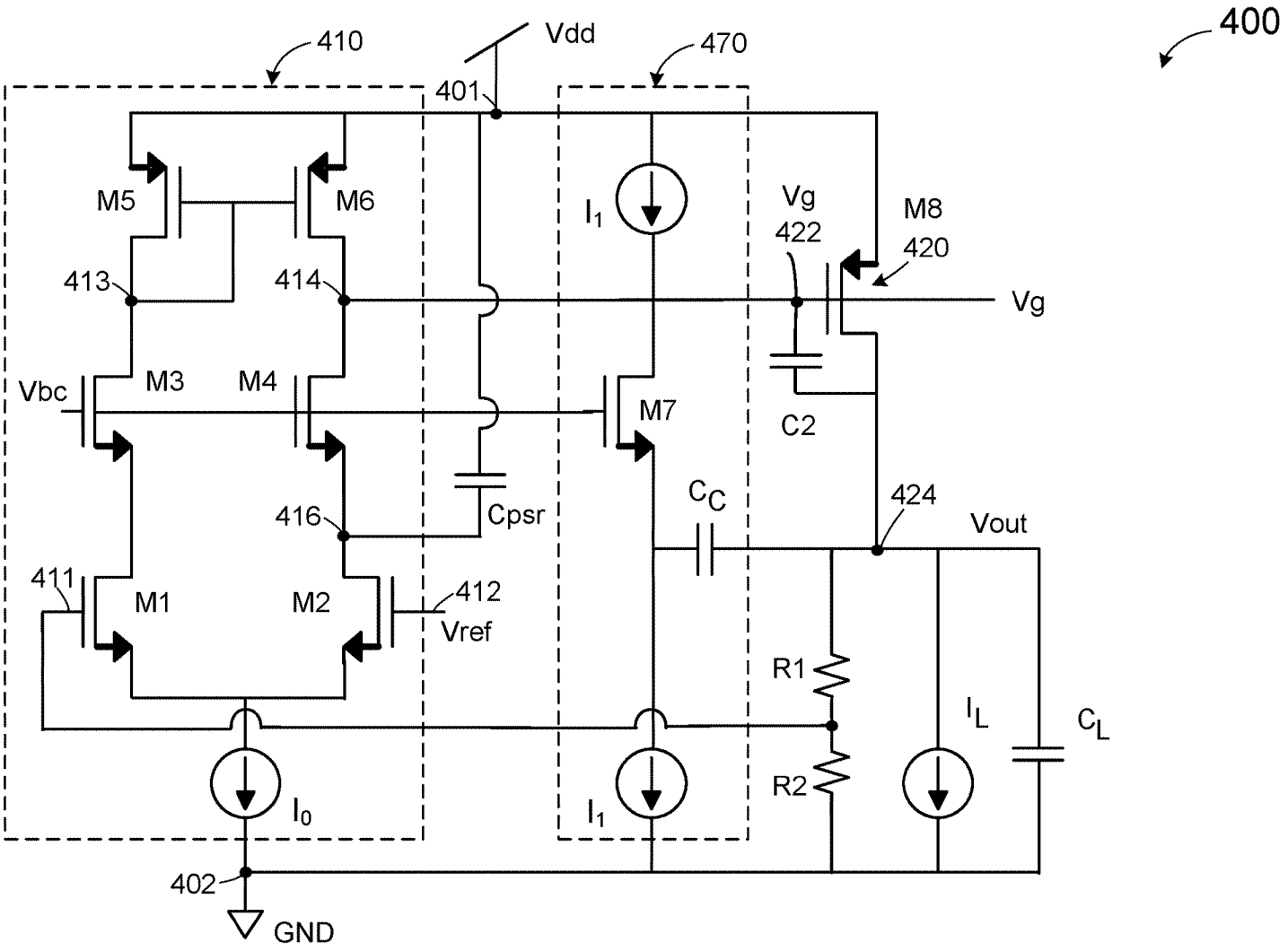
FIG. 4 is a simplified schematic diagram illustrating a low-dropout voltage regulator (LDO) according to some embodiments of the present invention.

FIG. 4 is a simplified schematic diagram illustrating a low-dropout voltage regulator (LDO) according to some embodiments of the present invention. In FIG. 4, voltage regulator 400 is a low-dropout voltage regulator (LDO). LDO 400 has a first power supply terminal 401 coupled to a supply voltage Vdd and a second power terminal 402 coupled to a ground GND.

As shown in FIG. 4, LDO 400 has a differential amplifier 410 and an output transistor 420. LDO 400 includes a pair of input transistors M1 and M2, a pair of bias transistors M3 and M4, and a pair of current mirror transistors M5 and M6 coupled between the power supply terminal 401 and the ground terminal 402, A bias voltage Vbc is coupled to a gate node of each of the pair of bias transistors M3, M4, and M7.

As shown in FIG. 4, LDO 400 also has a circuit 470 for Ahuja miller compensation for loop stability. Circuit 470 includes transistor M7 a capacitor Cc, a current source and a current sink providing a current $I_1$. Bias voltage Vbc is coupled to NMOS transistor in active region to increase the gain of the feedback loop, and to implement Ahuja miller compensation together with capacitor Cc, a current source, and a current sink providing a current I1 for loop stability.

Differential amplifier 410 includes a first input 411 at a gate node of a first transistor M1 for receiving a sample of the LDO output voltage Vout at output node 424 through a voltage divider made up of resistors R1 and R2. Differential amplifier 410 also includes a second input 412 at a gate node of a second transistor M2 for receiving a reference voltage, Vref, which can be provided, e. g., by a band-gap reference circuit (not shown). The first and second transistors M1 and M2 are coupled to the ground GND at power terminal 402 through a current sink that provides a current $I_0$. Differential amplifier 410 also includes a current mirror made up of two transistors M5 and M6. Current mirror M5 and M6 are coupled to Vdd at the power terminal 401. As shown in FIG. 4, differential amplifier 410 further include a transistor M3 disposed between transistors M1 and M5, and a transistor M4 disposed between transistors M2 and M6. The gate nodes of transistors M5 and M6 are coupled together, and these gate nodes are coupled to a node 413 between transistors M3 and M5 to form the current mirror. An output node for differential amplifier 410 is provided at a node 424 between transistors M4 and M6.

In the example of FIG. 4, transistors M1, M2, M3, and M4 are N-channel transistors, or NMOS transistors. Transistors M5 and M6 are P-channel transistors. Therefore, node 413 is coupled to the drain node of P-channel transistor M5 and the drain node of N-channel transistor M3. Node 414 is coupled to the drain node of P-channel transistor M6 and the drain node of N-channel transistor M4.

As shown in FIG. 4, the gate nodes of transistors M3 and M4 are coupled to a bias voltage Vbc. Therefore, node 416 at the source node of transistor M4 is at a gate-source voltage Vgs below the bias voltage Vbc and behaves like a virtual ground node. Alternatively, a virtual ground node can be located at a source node of transistor M3.

In the example of FIG. 4, output transistor 420 is a P-channel MOS transistor M8 (420) having a source node coupled to power supply Vdd, a gate node 422 at a gate voltage Vg. The gate node 422 of transistor M8 (420) is coupled to the output node 424 of the differential amplifier 410. An output node 424 is a drain node for transistor 420, and is also the output node 424 for LDO 400. A load for the LDO 400 is represented by a load capacitor $C_L$ and load current $I_L$.

In FIG. 4, capacitance C2 represents the built-in gate-drain overlap capacitance in transistor M8, which contributes to the degradation of the PSRR of LDO 400. For example, when Vdd rises or drops, the PMOS gate Vg cannot follow exactly Vdd due to current drawn from capacitance C2. Therefore, AC current (gm2*Vgs) is injected to Vout and degrades the PSRR performance. At a high frequency, the impedance of C2 is lower and leads to worse PSRR. In this example, C2 is just one example of undesired capacitive coupling. Other undesired capacitive coupling includes those coupled to Vbc, ground, etc. For instance, Capacitance $C_C$ represents a Miller compensation capacitor, which can also contributes to the degradation of the PSRR of LDO 400. Further, there can exist other capacitances associated with gate node 422 of output transistor M8, parasitic or by designed, that can interfere the ability of gate voltage Vg at gate node 422 of output transistor M8 to follow the variations of power supply voltage Vdd. These capacitances can include a capacitance between Vg and Vbc, between Vg to ground or a low-impedance node, etc. These capacitances can also contributes to the degradation of the PSRR of LDO 400.

In embodiments of the invention, a compensation capacitance is introduced to reduce the capacitances that degrade the PSRR of LDO 400. As shown in FIG. 4, a compensation capacitor Cpsr is coupled between power supply terminal 401 and a virtual ground node 416 in the differential amplifier to provide a current path between the power supply terminal and the gate node of the output transistor to reduce effects of capacitances that degrade the PSRR of the LDO. For example, if Vdd drops, Cpsr can cause an additional current to flow from Vdd to Vg, to reduce the impact of the undesirable capacitances on PSRR.

In some embodiments, the capacitance value of compensation capacitance can be determined by circuit simulation or hand calculation. For example, the PSRR can be determined by circuit simulation or hand calculation for different capacitance values of the compensation capacitance at different frequencies. A capacitance value of the compensation capacitance can be selected that, at a desirable frequency, provides the most PSRR improvement.

In order to confirm the effectiveness of the compensation capacitance, a circuit simulation study is carried out. At an optimal compensation capacitance value of about 3 nF at about 10 MHz, an improvement of about 25 db in PSRR can be achieved. In circuit implementation, component mismatch can prevent realization of the optical value. However, even with a compensation capacitance value that is about 25% off the optimal capacitance, an improvement of 12 db in PSRR can still be achieved.

Figure 5:
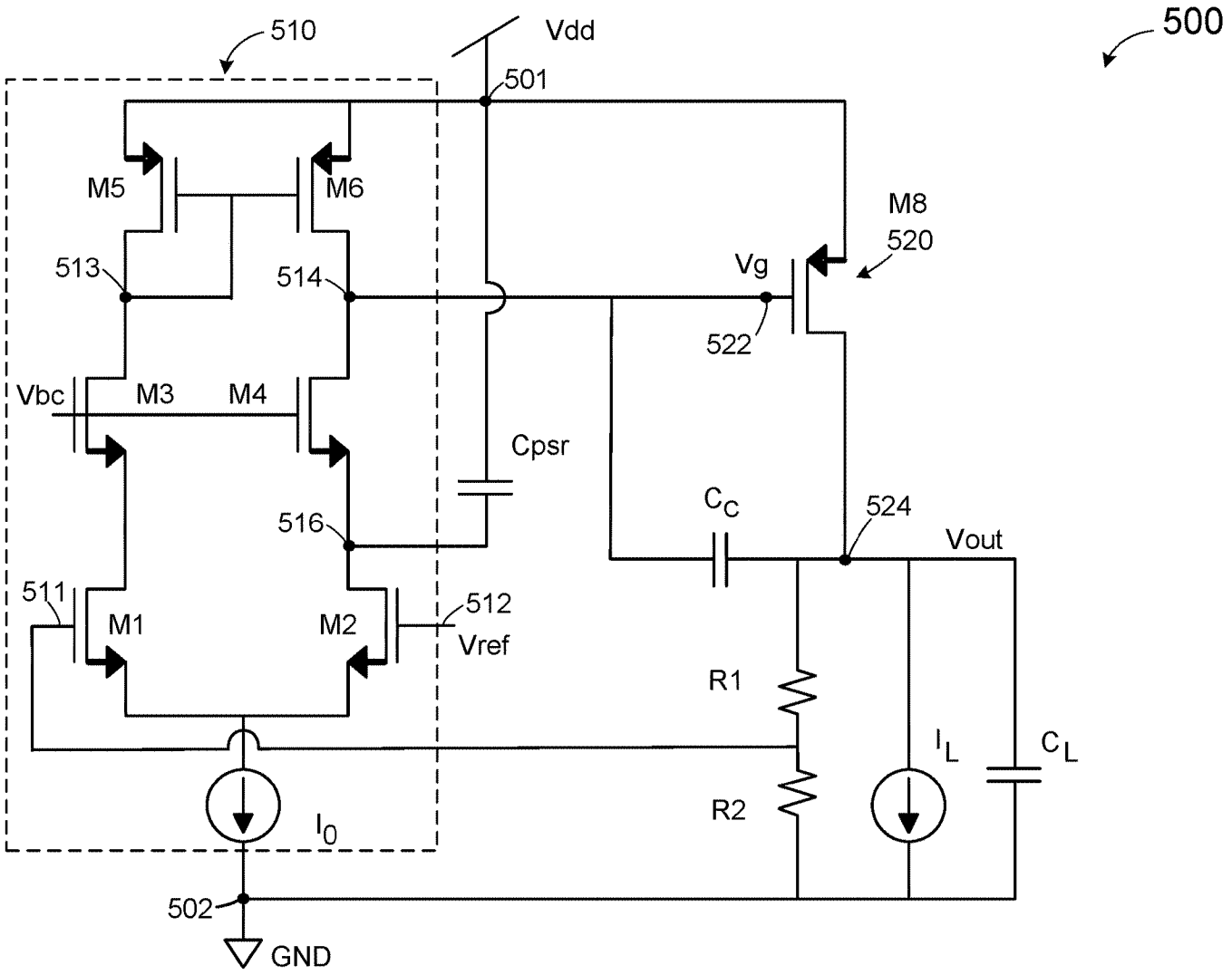
FIG. 5 is a simplified schematic diagram illustrating another low-dropout voltage regulator (LDO) according to some embodiments of the present invention.

FIG. 5 is a simplified schematic diagram illustrating another low-dropout voltage regulator (LDO) according to some embodiments of the present invention. In FIG. 5, voltage regulator 500 is a low-dropout voltage regulator (LDO). LDO 500 has a first power supply terminal 501 coupled to a supply voltage Vdd and a second power terminal 502 coupled to a ground GND.

As shown in FIG. 5, LDO 500 has a differential amplifier 510 and an output transistor 520. Differential amplifier 510 includes a first input 511 at a gate node of a transistor M1 for receiving a sample of the LDO output voltage Vout at output node 524 through a voltage divider made up of resistors R1 and R2. Differential amplifier 510 also includes a second input 512 at a gate node of a transistor M2 for receiving a reference voltage, Vref, which can be provided by a bandgap reference circuit (not shown). Transistors M1 and M2 are coupled to the ground GND at power terminal 502 through a current sink that provides a current $I_0$. Differential amplifier 510 also includes a current mirror made up of two transistors M5 and M6. Current mirror M5 and M6 are coupled to Vdd at the power terminal 501. As shown in FIG. 5, differential amplifier 510 further include a transistor M3 disposed between transistors M1 and M5, and a transistor M4 disposed between transistors M2 and M6. The gate nodes of transistors M5 and M6 are coupled together, and these gate nodes are coupled to a node 513 between transistors M3 and M5 to form the current mirror. An output node for differential amplifier 510 is provided at a node 524 between transistors M4 and M6.

In the example of FIG. 5, transistors M1, M2, M3, and M4 are N-channel transistors, or NMOS transistors. Transistors M5 and M6 are P-channel transistors. Therefore, node 513 is coupled to the drain node of P-channel transistor M5 and the drain node of N-channel transistor M3. Node 514 is coupled to the drain node of P-channel transistor M6 and the drain node of N-channel transistor M4.

As shown in FIG. 5, the gate nodes of transistors M3 and M4 are coupled to a bias voltage Vbc. Therefore, node 516 at the source node of transistor M4 is at a gate-source voltage Vgs below the bias voltage Vbc and behaves like a virtual ground node.

In the example of FIG. 5, output transistor 520 is a P-channel MOS transistor M8 (520) having a source node coupled to power supply Vdd, a gate node 522 at a gate voltage Vg. The gate node 522 of transistor M8 (520) is coupled to the output node 524 of the differential amplifier 510. An output node 524 is a drain node for transistor 520, and is also the output node for LDO 500. A load for the LDO 500 is represented by a load capacitor $C_L$ and load current $I_L$.

In FIG. 5, capacitance $C_C$ represents a Miller compensation capacitor, which can also contributes to the degradation of the PSRR of LDO 500, similar to capacitance C2 in FIG. 4. Further, there can exist other capacitances associated with gate node 522 of output transistor M8, parasitic or by designed, that can interfere the ability of gate voltage Vg at gate node 522 of output transistor M8 to follow the variations of power supply voltage Vdd. These capacitances can include a capacitance between Vg and Vbc, between Vg to ground or a low-impedance node, etc. These capacitances can also contributes to the degradation of the PSRR of LDO 500.

In embodiments of the invention, a compensation capacitance is introduced to reduce the capacitances that degrade the PSRR of LDO 500. As shown in FIG. 5, a compensation capacitor Cpsr is coupled between power supply terminal 501 and a virtual ground node 516 in the differential amplifier to provide a current path between the power supply terminal and the gate node of the output transistor to reduce effects of capacitances that degrade the PSRR of the LDO. For example, if Vdd drops, Cpsr can cause an additional current to flow from Vdd to Vg, to reduce the impact of the undesirable capacitances on PSRR.

In some embodiments, the capacitance value of compensation capacitance can be determined by circuit simulation or hand calculation. For example, the PSRR can be determined by circuit simulation or hand calculation for different capacitance values of the compensation capacitance at different frequencies. A capacitance value of the compensation capacitance can be selected that, at a desirable frequency, provides the most PSRR improvement.

Figure 6:
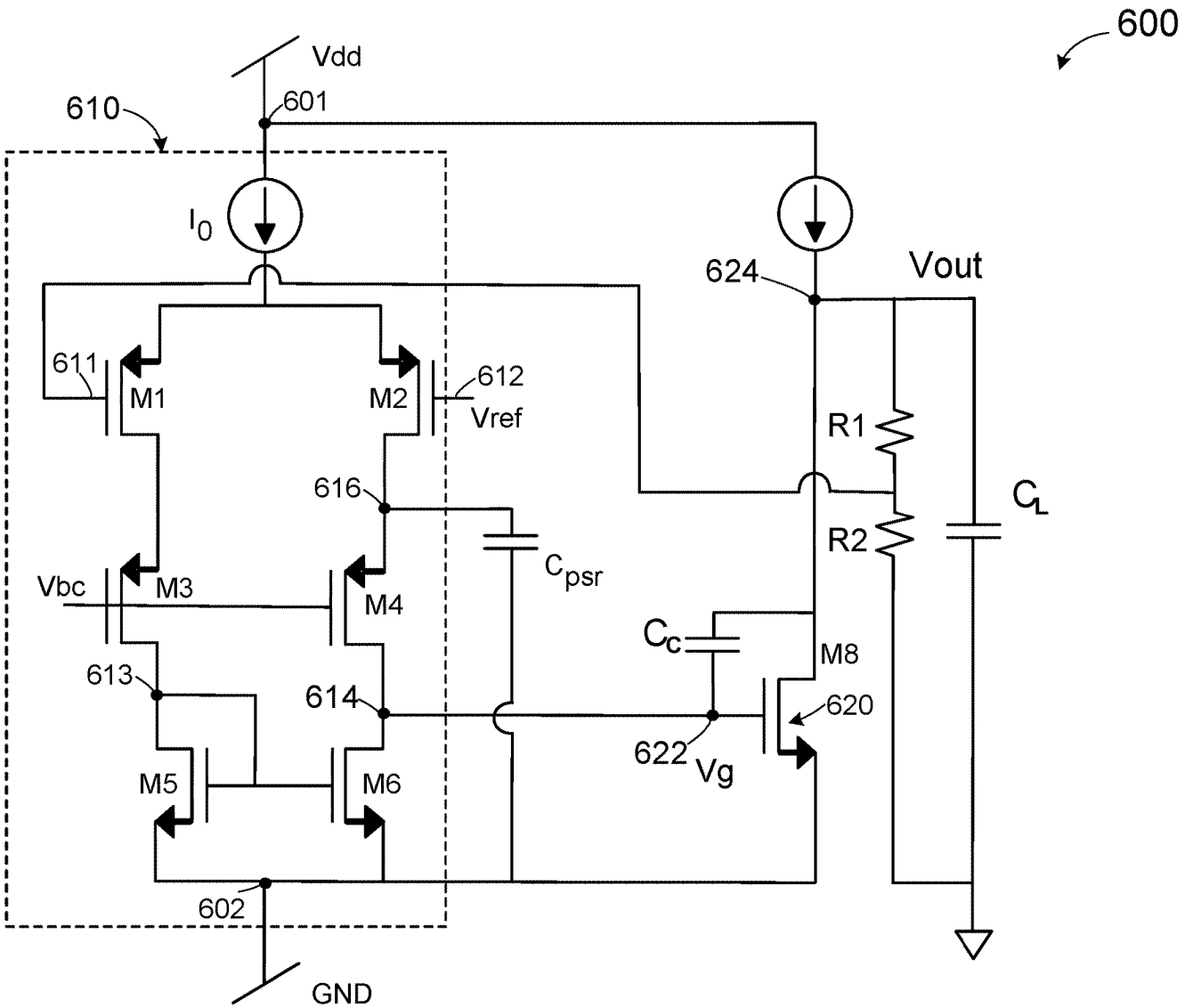
FIG. 6 is a simplified schematic diagram illustrating yet another low-dropout voltage regulator (LDO) according to some embodiments of the present invention.

FIG. 6 is a simplified schematic diagram illustrating yet another low-dropout voltage regulator (LDO) according to some embodiments of the present invention. In FIG. 6, voltage regulator 600 is a low-dropout voltage regulator (LDO). LDO 500 has a first power supply terminal 501 coupled to a supply voltage Vdd and a second power terminal 502 coupled to a ground GND. LDO 600 is similar to LDO 500 in FIG. 5. One difference is that LDO 600 has an N-channel transistor as the output transistor, and the circuit topology is an N-channel version of LDO 500 in FIG. 5.

As shown in FIG. 6, LDO 600 has a differential amplifier 610 and an output transistor 620. Differential amplifier 610 includes a first input 611 at a gate node of a transistor M1 for receiving a sample of the LDO output voltage Vout at output node 624 through a voltage divider made up of resistors R1 and R2. Differential amplifier 610 also includes a second input 612 at a gate node of a transistor M2 for receiving a reference voltage, Vref, which can be provided by a band-gap reference circuit (not shown). Transistors M1 and M2 are coupled to the a power supply Vdd at power terminal 601 through a current source that provides a current $I_0$. Differential amplifier 610 also includes a current mirror made up of two transistors M5 and M6. Current mirror M5 and M6 are coupled to a ground node GND at the power terminal 602. As shown in FIG. 6, differential amplifier 610 further include a transistor M3 disposed between transistors M1 and M5, and a transistor M4 disposed between transistors M2 and M6. The gate nodes of transistors M5 and M6 are coupled together, and these gate nodes are coupled to a node 613 between transistors M3 and M5 to form the current mirror. An output node for differential amplifier 610 is provided at a node 624 between transistors M4 and M6.

In the example of FIG. 6, transistors M1, M2, M3, and M4 are P-channel transistors, or NMOS transistors. Transistors M5 and M6 are N-channel transistors. Therefore, node 613 is coupled to the drain node of N-channel transistor M5 and the drain node of P-channel transistor M3. Node 614 is coupled to the drain node of N-channel transistor M6 and the drain node of P-channel transistor M4.

As shown in FIG. 6, the gate nodes of transistors M3 and M4 are coupled to a bias voltage Vbc. Therefore, node 616 at the source node of transistor M4 is at a gate-source voltage Vgs above the bias voltage Vbc and behaves like a virtual ground node, similar to the virtual ground nodes in FIGS. 4 and 5.

In the example of FIG. 6, output transistor 620 is an N-channel MOS transistor M8 (520) having a source node coupled to ground GND, and a gate node 622 at a gate voltage Vg. The gate node 622 of transistor M8 (520) is coupled to the output node 624 of the differential amplifier 610. An output node 624 is a drain node for transistor 620, and is also the output node for LDO 600. Node 624 is coupled to the power supply Vdd through a current source providing a current $I_L$. A load for the LDO 600 is represented by a load capacitor $C_L$.

In FIG. 6, capacitance $C_C$ represents a Miller compensation capacitor, which can also contributes to the degradation of the PSRR of LDO 600, similar to capacitance $C_C$ in FIG. 5. Further, there can exist other capacitances associated with gate node 622 of output transistor M8, parasitic or by designed, that can interfere the ability of gate voltage Vg at gate node 622 of output transistor M8 to follow the variations of power supply voltage Vdd. These capacitances can include a capacitance between Vg and Vbc, between Vg to ground or a low-impedance node, etc. These capacitances can also contributes to the degradation of the PSRR of LDO 600.

In embodiments of the invention, a compensation capacitance is introduced to reduce the capacitances that degrade the PSRR of LDO 600. As shown in FIG. 6, a compensation capacitor Cpsr is coupled between ground terminal 602 and a virtual ground node 616 in the differential amplifier 610 to provide a current path between the ground terminal and the gate node of the output transistor to reduce effects of capacitances that degrade the PSRR of the LDO.

In some embodiments, the capacitance value of compensation capacitance can be determined by circuit simulation or hand calculation. For example, the PSRR can be determined by circuit simulation or hand calculation for different capacitance values of the compensation capacitance at different frequencies. A capacitance value of the compensation capacitance can be selected that, at a desirable frequency, provides the most PSRR improvement.

Figure 7:
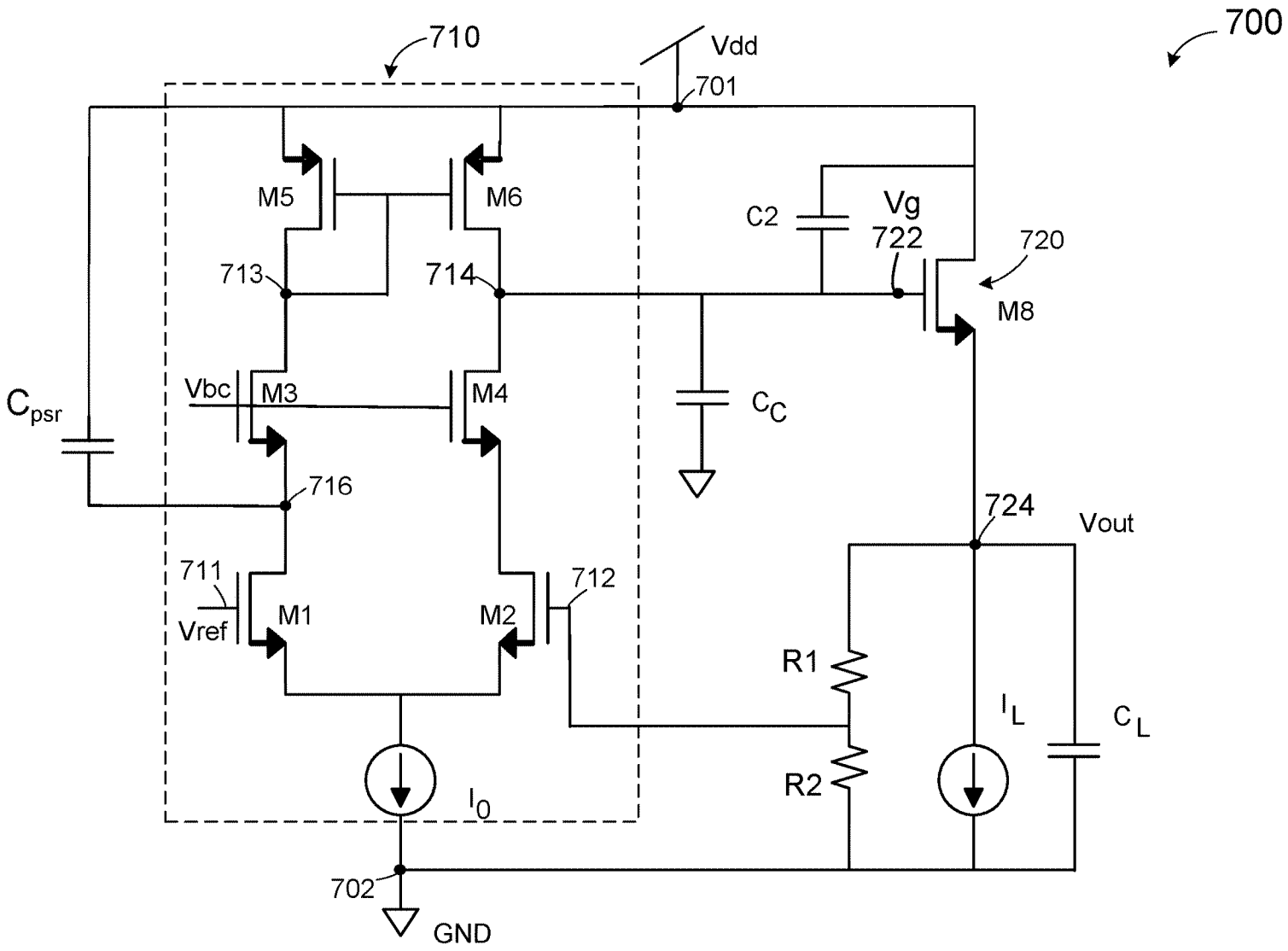
FIG. 7 is a simplified schematic diagram illustrating a voltage regulator according to some embodiments of the present invention.

FIG. 7 is a simplified schematic diagram illustrating a voltage regulator according to some embodiments of the present invention. In FIG. 7, voltage regulator 700 is a voltage in a source follower topology with an N-channel transistor as the output transistor. Voltage regulator 700 has a first power supply terminal 701 coupled to a supply voltage Vdd and a second power terminal 702 coupled to a ground GND.

As shown in FIG. 7, voltage regulator 700 has a differential amplifier 710 and an output transistor 720. Differential amplifier 710 includes a first input 712 at a gate node of a transistor M1 for receiving a sample of the LDO output voltage Vout at output node 724 through a voltage divider made up of resistors R1 and R2. Differential amplifier 710 also includes a second input 711 at a gate node of a transistor M2 for receiving a reference voltage, Vref, which can be provided by a band-gap reference circuit (not shown). Transistors M1 and M2 are coupled to the ground GND at power terminal 702 through a current sink that provides a current $I_0$. Differential amplifier 710 also includes a current mirror made up of two transistors M5 and M6. Current mirror M5 and M6 are coupled to Vdd at the power terminal 701. As shown in FIG. 7, differential amplifier 710 further include a transistor M3 disposed between transistors M1 and M5, and a transistor M4 disposed between transistors M2 and M6. The gate nodes of transistors M5 and M6 are coupled together, and these gate nodes are coupled to a node 713 between transistors M3 and M5 to form the current mirror. An output node for differential amplifier 710 is provided at a node 724 between transistors M4 and M6.

In the example of FIG. 7, transistors M1, M2, M3, and M4 are N-channel transistors, or NMOS transistors. Transistors M5 and M6 are P-channel transistors, or PMOS transistors. Therefore, node 713 is coupled to the drain node of P-channel transistor M5 and the drain node of N-channel transistor M3. Node 714 is coupled to the drain node of P-channel transistor M6 and the drain node of N-channel transistor M4.

As shown in FIG. 7, the gate nodes of transistors M3 and M4 are coupled to a bias voltage Vbc. Therefore, node 716 at the source node of transistor M3 is at a gate-source voltage Vgs below the bias voltage Vbc and behaves like a virtual ground node, similar to the virtual ground nodes in FIGS. 4-6.

In the example of FIG. 7, output transistor 720 is an N-channel MOS transistor M8 (720) having a drain node coupled to power supply Vdd, a gate node 722 at a gate voltage Vg. The gate node 722 of transistor M8 (720) is coupled to the output node 724 of the differential amplifier 710. An output node 724 is a source node for transistor 720, and is also the output node for voltage regulator 700 in the source follower configuration. A load for Voltage regulator 700 is represented by a load capacitor $C_L$ and load current $I_L$.

In FIG. 7, capacitance $C_C$ represents a Miller compensation capacitor, which can also contributes to the degradation of the PSRR of voltage regulator 700, similar to capacitance $C_C$ in FIG. 4. Further, there can exist other capacitances associated with gate node 722 of output transistor M8, parasitic or by designed, that can interfere the ability of gate voltage Vg at gate node 722 of output transistor M8 to follow the variations of power supply voltage Vdd. These capacitances can include a capacitance between Vg and Vbc, between Vg to ground or a low-impedance node, etc. These capacitances can also contributes to the degradation of the PSRR of voltage regulator 700.

In embodiments of the invention, a compensation capacitance is introduced to reduce the capacitances that degrade the PSRR of voltage regulator 700. As shown in FIG. 7, a compensation capacitor Cpsr is coupled between power supply terminal 701 and a virtual ground node 716 in the differential amplifier to provide a current path between the power supply terminal and the gate node of the output transistor to reduce effects of capacitances that degrade the PSRR of the voltage regulator. For example, if Vdd drops, Cpsr can cause an additional current to flow from Vdd to Vg, to reduce the impact of the undesirable capacitances on PSRR.

In some embodiments, the capacitance value of compensation capacitance can be determined by circuit simulation or hand calculation. For example, the PSRR can be determined by circuit simulation or hand calculation for different capacitance values of the compensation capacitance at different frequencies. A capacitance value of the compensation capacitance can be selected that, at a desirable frequency, provides the most PSRR improvement.

In some embodiment, the voltage regulator circuits described above in connection with FIGS. 1-7 can be used in CMOS image sensors. For example, an image sensor can include a voltage regulator circuit, which includes a power supply terminal and a ground terminal and a differential amplifier coupled between the power supply terminal and the ground terminal. The voltage regulator circuit can also include an output transistor, including a gate node coupled to an output node of the differential amplifier to receive a gate voltage and to provide a regulated output voltage at an output node of the output transistor, wherein the differential amplifier is configured to provide the gate voltage based on a differential between a reference voltage and the regulated output voltage. The voltage regulator circuit can also include a compensation capacitance coupled between a virtual ground node and either the power supply terminal or the ground terminal, the compensation capacitance providing a current path to the gate node of the output transistor.

Figure 8:
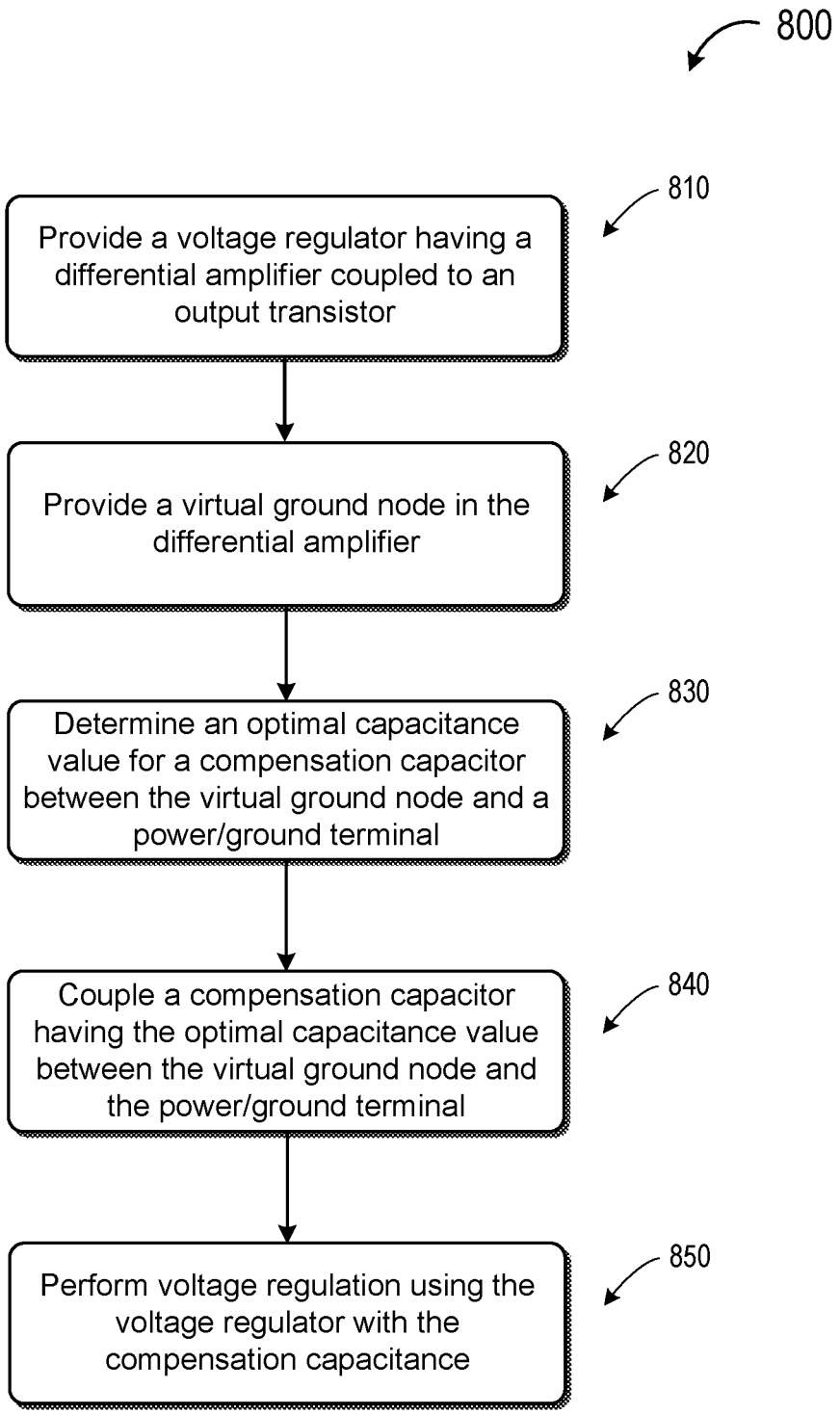
FIG. 8 is a simplified flowchart illustrating a method for a distributed voltage regulators structure according to some embodiments of the present invention.

FIG. 8 is a simplified flowchart illustrating a method for a distributed voltage regulators structure according to some embodiments of the present invention. As shown in the flowchart of FIG. 8, a method 800 can be summarized as follows:

Process 810—Provide a voltage regulator having a differential amplifier coupled to an output transistor;

Process 820—Provide a virtual ground node in the differential amplifier;

Process 830—Determine a capacitance value for a compensation capacitor between a gate node of the output transistor and the virtual ground node in the differential amplifier for improving the PSRR of the voltage regulator;

Process 840—Couple a compensation capacitor having the determined capacitance value between the gate node of the output transistor and the virtual ground node in the differential amplifier; and Process 850—Perform voltage regulation using the voltage regulator with the compensation capacitance.

At 810, the method includes providing a linear voltage regulator having a differential amplifier coupled to an output transistor. Examples of the linear voltage regulator are described above in connection with FIGS. 3-7. The differential amplifier and the output transistor are coupled at a gate node of the output transistor. The voltage regulator provides a regulated output voltage at an output node of the output transistor.

At 820, the method includes providing a virtual ground node in the differential amplifier. Examples of the virtual ground in various linear voltage regulators are described above in connection with FIGS. 3-7.

At 830, the method includes determining an optimal capacitance value for a compensation capacitor between a gate node of the output transistor and the virtual ground node in the differential amplifier for improving the PSRR of the voltage regulator. As described above, the optimal capacitance value can be determined using circuit simulation techniques. In some cases, the capacitance value can be determined by hand calculation.

At 840, the method includes coupling a compensation capacitor having the optimal capacitance value between the gate node of the output transistor and the virtual ground node in the differential amplifier.

At 850, the method includes performing voltage regulation using the linear voltage regulator with the compensation capacitance. Examples of various linear voltage regulators including the compensation capacitance are described above in connection with FIGS. 3-7.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art. Indeed, the methods and systems described herein may be embodied in a variety of other forms; furthermore, various omissions, substitutions and changes in the form of the methods and systems described herein may be made without departing from the spirit of the present disclosure. The accompanying claims and their equivalents are intended to cover such forms or modifications as would fall within the scope and spirit of the present disclosure.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some embodiments. The methods and processes described herein are also not limited to any particular sequence, and the blocks or states relating thereto can be performed in other sequences that are appropriate. For example, described blocks or states may be performed in any order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A linear voltage regulator circuit, comprising:

a power supply terminal and a ground terminal;

a differential amplifier coupled between the power supply terminal and the ground terminal, wherein the differential amplifier is configured to amplify a differential between a reference voltage and a regulated output voltage, wherein the differential amplifier comprises:

a pair of input transistors, a pair of bias transistors, and a pair of current mirror transistors;

a gate node of each of the pair of bias transistors being coupled to a bias voltage; and a virtual ground node at a source node of one of the pair of bias transistors;

an output transistor, including a gate node coupled to the differential amplifier, a source node coupled to the power supply terminal, and a drain node providing the regulated output voltage; and a compensation capacitor coupled between the power supply terminal and the virtual ground node in the differential amplifier to provide a current between the power supply terminal and the gate node of the output transistor to reduce effects of capacitances coupled to the gate node of the output transistor that degrade PSRR (Power Supply Rejection Ratio) of the linear voltage regulator.

2. The linear voltage regulator circuit of claim 1, wherein:

the pair of input transistors including a first transistor for receiving a sample of the regulated output voltage and a second transistor for receiving a reference voltage;

the pair of bias transistors including a third transistor and a fourth transistor coupled between the pair of input transistors and the pair of current mirror transistors, the bias voltage being coupled to respective gate nodes of the third and fourth transistors; and the pair of current minor transistors including a fifth transistor and a sixth transistor having their respective gate nodes coupled together and coupled to a drain node of the fifth transistor;

wherein the virtual ground node is located at a source node of the third or the fourth transistor.

3. The linear voltage regulator circuit of claim 2, wherein:

the first, second, third, and fourth transistors are N-channel transistors; and the fifth and sixth transistors are P-channel transistors.

4. The linear voltage regulator circuit of claim 3, wherein the output transistor is a P-channel transistor, and the regulated output voltage is provided at a drain node of the output transistor.

5. The linear voltage regulator circuit of claim 3, wherein the output transistor is an N-channel transistor, and the regulated output voltage is provided at a source node of the output transistor.

6. A voltage regulator circuit, comprising:

a power supply terminal and a ground terminal;

a differential amplifier coupled between the power supply terminal and the ground terminal, the differential amplifier comprising a pair of input transistors, a pair of bias transistors, and a pair of current mirror transistors;

an output transistor, including a gate node coupled to an output node of the differential amplifier to receive a gate voltage and to provide a regulated output voltage at an output node of the output transistor, wherein the differential amplifier is configured to provide the gate voltage based on a differential between a reference voltage and the regulated output voltage; and a compensation capacitance coupled between a virtual ground node and either the power supply terminal or the ground terminal, the virtual ground node being at a source node of one of the pair of bias transistors, the compensation capacitance providing a current path to the gate node of the output transistor.

7. The voltage regulator circuit of claim 6, wherein the compensation capacitance is configured to reduce effects of capacitances that degrade PSRR (Power Supply Rejection Ratio).

8. The voltage regulator circuit of claim 1, wherein:

the pair of input transistors including a first transistor for receiving a sample of the regulated output voltage and a second transistor for receiving a reference voltage;

the pair of bias transistors including a third transistor and a fourth transistor coupled between the pair of input transistors and the pair of current mirror transistors, a bias voltage being coupled to respective gate nodes of the third and fourth transistors;

the pair of current mirror transistors including a fifth transistor and a sixth transistor having their respective gate nodes coupled together and coupled to a drain node of the fifth transistor;

wherein the virtual ground node is located at a source node of the third or the fourth transistor.

9. The voltage regulator circuit of claim 8, wherein the compensation capacitance is coupled between a power supply terminal and the virtual ground node.

10. The voltage regulator circuit of claim 9, wherein:

the first, second, third, and fourth transistors are N-channel transistors; and the fifth and sixth transistors are P-channel transistors.

11. The voltage regulator circuit of claim 9, wherein the output transistor is a P-channel transistor, and the output node is a drain node of the output transistor.

12. The voltage regulator circuit of claim 9, wherein the output transistor is an N-channel transistor, and the output node is a source node of the output transistor.

13. The voltage regulator circuit of claim 8, wherein the output transistor is an N-channel transistor, and the output node is a drain node of the N-channel transistor.

14. The voltage regulator circuit of claim 13, wherein the compensation capacitance is coupled between a ground terminal and the virtual ground node.

15. The voltage regulator circuit of claim 13, wherein:

the first, second, third, and fourth transistors are P-channel transistors; and the fifth and sixth transistors are N-channel transistors.

16. An image sensor, comprising a voltage regulator circuit, comprising:

a power supply terminal and a ground terminal;

a differential amplifier coupled between the power supply terminal and the ground terminal, and comprising a pair of input transistors, a pair of bias transistors, and a pair of current mirror transistors coupled between a power supply terminal and a ground terminal;

an output transistor, including a gate node coupled to an output node of the differential amplifier to receive a gate voltage and to provide a regulated output voltage at an output node of the output transistor, wherein the differential amplifier is configured to provide the gate voltage based on a differential between a reference voltage and the regulated output voltage; and a compensation capacitance coupled between a virtual ground node and either the power supply terminal or the ground terminal, the virtual ground node being at a source node of one of the pair of bias transistors, the compensation capacitance providing a current path to the gate node of the output transistor.

17. A method, comprising:

providing a voltage regulator having a differential amplifier coupled to a gate node of an output transistor, the differential amplifier comprising a pair of input transistors, a pair of bias transistors, and a pair of current mirror transistors coupled between a power supply terminal and a ground terminal;

providing a virtual ground node in the voltage regulator at a source node of one of the pair of bias transistors;

determining a capacitance value for a compensation capacitor between a power terminal and the virtual ground node for providing a current to the gate node of the output transistor to improve PSRR (Power Supply Rejection Ratio) of the voltage regulator; and coupling a compensation capacitor having the determined capacitance value between the power terminal and the virtual ground node in the differential amplifier.

18. The method of claim 17, further comprising performing voltage regulation using the voltage regulator with the compensation capacitor.

19. The method of claim 17, wherein:

a bias voltage is coupled to a gate node of each of the pair of bias transistors.

* * * * *